US005259148A

United States Patent [19]

Wiand

[11] Patent Number: 5,259,148

[45] Date of Patent: Nov. 9, 1993

[54] RING GENERATOR WHEEL WITH IMPROVED COOLANT FLOW

[76] Inventor: Ronald C. Wiand, 1494 Heatherwood Dr., Troy, Mich. 48098

[21] Appl. No.: 790,391

[22] Filed: Nov. 12, 1991

[51] Int. Cl.[5] ..... B24B 55/02

[52] U.S. Cl. ..... 51/267; 51/206 R

[58] Field of Search ..... 51/266, 267, 204, 206 R

[56] References Cited

U.S. PATENT DOCUMENTS

| | | | |
|---|---|---|---|
| 2,027,132 | 1/1936 | Webster . | |
| 2,455,597 | 12/1948 | Metzger et al. | 51/267 |
| 2,733,562 | 2/1956 | Drummond | 51/267 |
| 2,738,625 | 3/1956 | Strnad | 51/267 |
| 2,840,960 | 7/1958 | Booth | 51/267 |
| 3,110,993 | 11/1963 | Grage | 51/267 |
| 3,290,834 | 12/1966 | Lindblad . | |
| 3,831,236 | 8/1974 | Coburn et al. . | |
| 4,209,950 | 7/1980 | Sielemann | 51/267 |
| 4,534,773 | 8/1985 | Phaal et al. . | |

FOREIGN PATENT DOCUMENTS

| | | | |
|---|---|---|---|
| 1-40967 | 6/1989 | Japan | 51/267 |
| 0321620 | 5/1957 | Switzerland | 51/267 |
| 1463456 | 3/1989 | U.S.S.R. | 51/267 |
| 0696198 | 8/1953 | United Kingdom | 51/267 |
| 1215064 | 12/1970 | United Kingdom | 51/267 |

*Primary Examiner*—Roscoe V. Parker
*Attorney, Agent, or Firm*—Harness, Dickey & Pierce

[57] ABSTRACT

A ring generator wheel with improved coolant flow. The ring generator wheel of the present invention includes a shaft portion which is adapted for connection to an ophthalmic lens generating machine. A body portion is connected to the shaft and includes a first side adjacent the shaft portion and a second opposite side which has a wall member extending therefrom for forming a cup surface on the second side. The wall member has a radially inner surface, a radially outer surface and a peripheral edge, which peripheral edge includes a cutting surface for cutting of a lens. A deflection plate is provided having portions thereof extending generally radially and spaced from the second side for directing coolant media into the radially inner surface of the outer wall. The body portion includes surfaces for forming an aperture through the body portion from the first side to the second side for allowing coolant to pass therethrough. A shroud member is provided for containing a coolant on the second side. The coolant is directed at the shroud means and is contained and pumped through the aperture means to be distributed via the deflection plate to the radially inner wall for providing increased flow of coolant to the cutting surface.

68 Claims, 3 Drawing Sheets

RING GENERATOR WHEEL WITH IMPROVED COOLANT FLOW

BACKGROUND

The present invention relates to a ring generator wheel of the type used in ophthalmic lens grinding. More specifically, the present invention relates to a ring generator wheel with improved coolant flow.

In today's ophthalmic market plastic lenses have replaced glass lenses in all but a few specialized applications. The primary market for glass lenses which are generated today are photochromic glass lenses. Generating of photochromic glass has lead to two readily apparent problems in the industry. First, photochromic glass is a much tougher material to grind than normal plastic lens materials and the like, and therefore, generator wheels are subject to excessive wear under normal operating conditions. Second, the spoilage rate for photochromic lenses is much higher than normal glass lenses in that a higher percentage of the lenses are heat cracked during generation of the lens curvatures. Thus, with the cost of materials and the spoilage rate high there has been a need for improved generating system for glass lenses, and in particular, photochromic lenses.

SUMMARY OF THE INVENTION

In accordance with the present invention there is provided a ring generator wheel with improved coolant flow. The ring generator wheel of the present invention includes a shaft portion which is adapted for connection to an ophthalmic lens generating machine. A body portion is connected to the shaft and includes a first side adjacent the shaft portion and a second opposite side which has a wall member extending therefrom for forming a cup surface on the second side. The wall member has a radially inner surface, a radially outer surface and a peripheral edge, which peripheral edge includes a cutting surface for cutting of a lens. A deflection plate is provided having portions thereof extending generally radially and spaced from the second side for directing coolant media into the radially inner surface of the outer wall. The body portion includes surfaces for forming an aperture through the body portion from the first side to the second side for allowing coolant to pass therethrough. A shroud member is provided for containing a coolant on the second side. The coolant is directed at the shroud means and is contained and pumped through the aperture means to be distributed via the deflection plate to the radially inner wall for providing increased flow of coolant to the cutting surface.

It is an object of the present invention to provide a lens generating wheel which has improved coolant flow, longer life and increased speed of cutting.

Further understanding of the present invention, including further benefits and advantages, will be realized from the subsequent brief description of the drawings, description of the preferred embodiments and the appended claims.

DESCRIPTION OF THE PREFERRED EMBODIMENT

Figure 1:
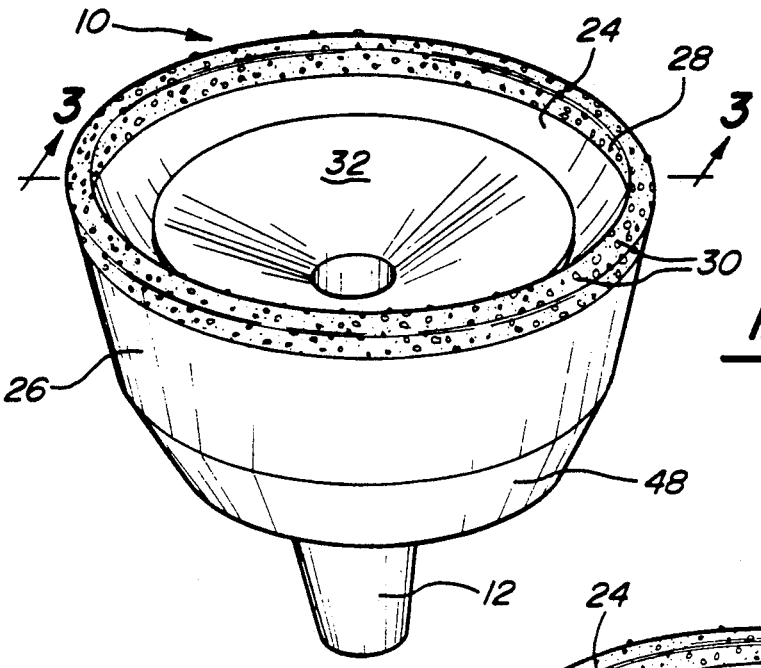
FIG. 1 is a bottom perspective view of the generating wheel of the present invention.
Figure 2:
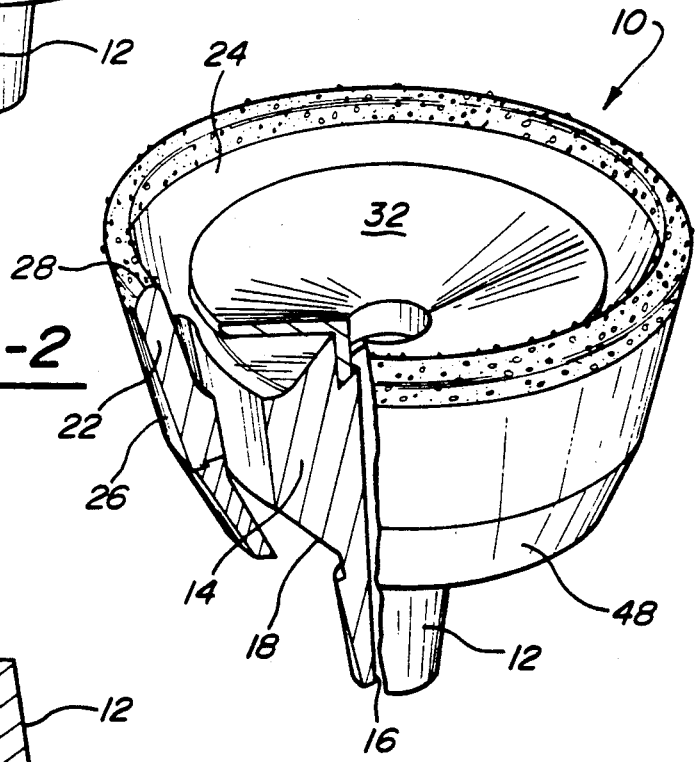
FIG. 2 is a bottom perspective view similar to FIG. 1 broken away to show the inner detail of the generating view of the present invention.
Figure 3:
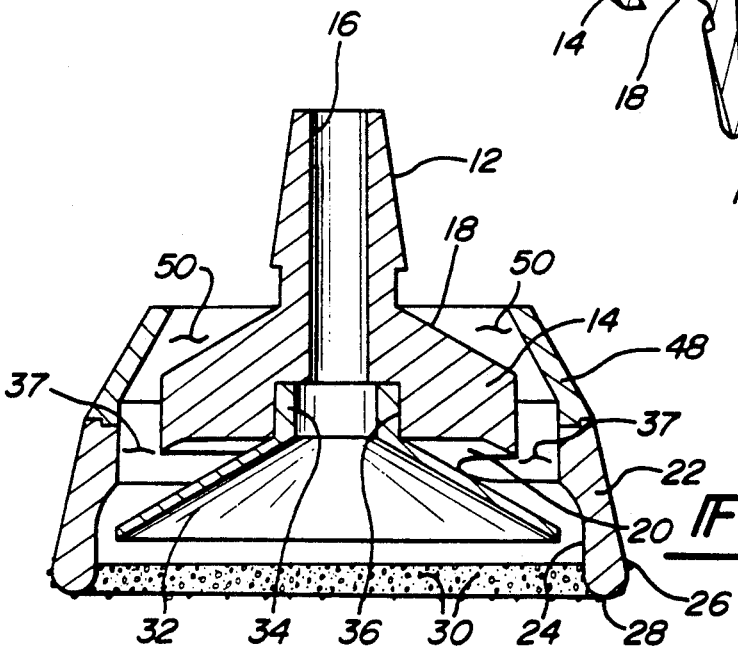
FIG. 3 is a sectional view taken along line 3—3 of FIG. 1 showing the generator wheel of the present invention in its operating position.

In accordance with the present invention there is provided an improved ring generator wheel generally shown at 10 which has improved coolant flow. The ring generator wheel of the present invention includes a shaft portion 12 and a body portion 14. The shaft portion 12 is adapted for connection to an ophthalmic lens generating machine as is readily known in the art. Shaft portion 12 includes a central orifice 16. Central orifice 16 is not essential to the operation of the present invention. However, the orifice 16 can be utilized with conventional generating machines to provide extra coolant if desired in a particular application. Shaft portion 12 may be of the commonly known male (shown) or female (not shown) type adapted for attachment to a lens generating machine.

The body portion 14 includes a first inlet side 18 adjacent the shaft portion and a second outlet side 20. The second side 20 forms a cup surface on the second side in cooperation with wall member 22 which extends from the second side 20. The wall member has a radially inner surface 24 and a radially outer surface 26. The wall member 22 also includes a radiused end portion 28 which has a cutting surface comprised of an abrasive grit material 30 or other cutting means, such as polycrystalline diamond flycutters, for cutting of a glass lens during rotation of the wheel 10. In a preferred embodiment the radiused cutting edge is a toric section with diamond grit brazedly attached.

A deflection plate 32, which includes a hub portion 34, is brazedly attached to the body portion 14 at orifice 36. In the preferred embodiment the deflection plate 32 is circular and shaped in a frustoconical shape, as shown in the figures. The deflection plate is configured such that the narrow portion on the cone near the hub 34 and the wider portion of the cone extending outward and spaced from the second outlet side 20. Of course, other deflection plates may be utilized such as a flat plate or other configurations which would allow deflection of coolant to the inner surface 24 of the wall 22.

The present invention includes an integral coolant pump means which operates to pump coolant from the first inlet side 18 to the second outlet side 20 during rotation of the wheel. The coolant pump means includes aperture means 37 and shroud means 48.

The present invention includes surfaces for forming an aperture means generally indicated at 37 through the body portion from the first inlet side 18 through to the second outlet side 20 for allowing a coolant to pass therethrough. In a preferred embodiment a plurality of concentric arcuate slots 38, 40 and 42 are provided. These slots are formed with angled end portions shown best in FIGS. 4 and 4*a* at 44 and 46 which are surfaces parallel in angle. In operation the slots 38, 40 and 42 in conjunction with the surfaces 44 and 46 form a vane pump for pumping coolant through the slots as coolant is supplied. Thus, each of the surfaces 44 and 46 are at an angle "a" to a plane drawn perpendicular to the axis of rotation such that during rotation the edge 49 formed at the interface of surface 46 with first inlet side 18 in essence shears through the coolant forcing the coolant through the apertures 37 to be pressurized against the deflection plate 32. The angle "a" is preferably from about 5° to about 45° and more preferably from about 15° to about 20°. The slots are formed such that the surface 46 and edge 49 are rotating for shearing into a coolant.

A shroud means 48 is provided for containing coolant on the first inlet side 18. The shroud means 48 is preferably a wall member portion brazedly attached to the body and extending therefrom in the axial direction of the shaft. In a preferred embodiment, the wall means is a frustoconical wall which is angled with a smaller portion of the cone toward the shaft portion such that coolant directed into the interior chamber 50 will be retained during rotation of the generator wheel 10. The cone angle of frustoconical wall 48 is generally from about 30° to about 90°.

Figure 4:
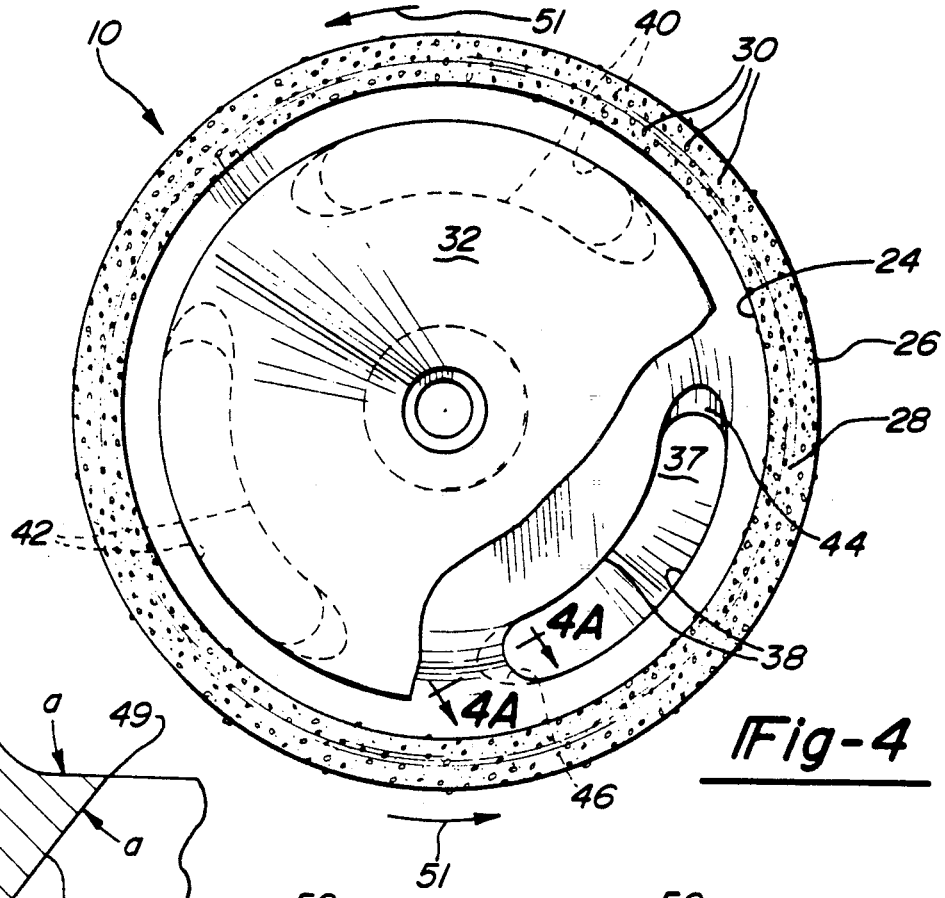
FIG. 4 is a bottom plan view showing the cutting surface, deflection plate and slotted apertures of the present invention with other details in phantom.
Figure 4A:
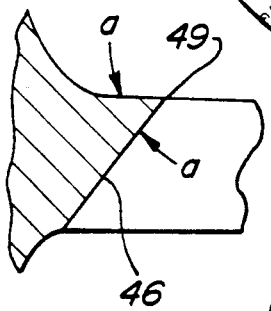
FIG. 4*a* is a detailed sectional view of the vane pumping surface of the slots through the generator wheel body.
Figure 5:
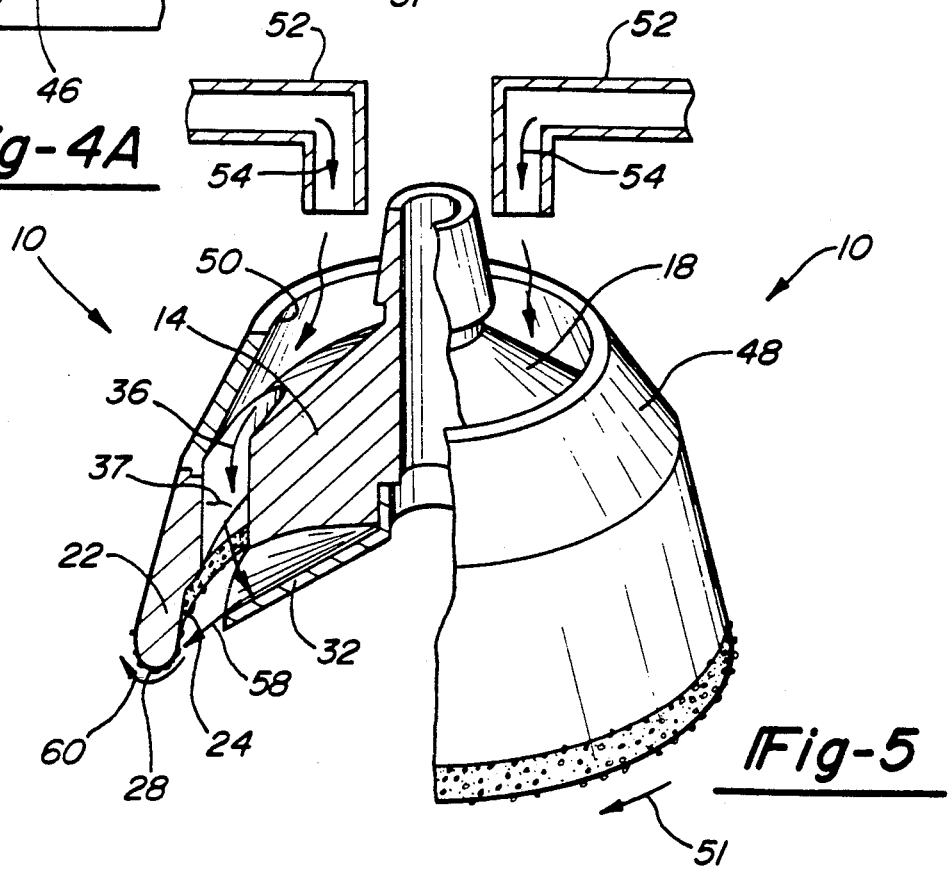
FIG. 5 is a top perspective view of the present invention partially broken away for showing coolant flow during lens generating operations.

Referring now to FIGS. 4 and 5, in operation with a generator wheel inserted in a lens generating machine (not shown) and rotated in a direction of the arrows 51 shown in FIG. 4 the coolant is pumped onto the radiused cutting surface 28 as described below. In a preferred embodiment coolant supply pipes indicated at 52 are provided adjacent the chuck of the generating machine. These supply pipes pump coolant such as water or mineral oil in the direction of arrows 54 into the chamber 50 formed by frustoconical wall 48. Because of the above described effect formed by slots 38, 40 and 42 and the surfaces 46 and 44, a vane pump is set up in the generator wheel of the present invention such that coolant is pumped, as shown by arrow 56, through the body portion and to the deflection plate 32. With proper coolant flow the coolant is pressurized against the deflection plate 32, thereby enhancing coolant delivery to the cutting surfaces of the wheel.

Because of the centrifugal force against the coolant as a result of the rotation of deflection plate 32 the coolant is thereafter routed in the direction of arrow 58 to the inner surface 24 of the wall 22 and thereafter the coolant flows advantageously around the radiused portion 28 as shown by arrow 60.

Figure 6:
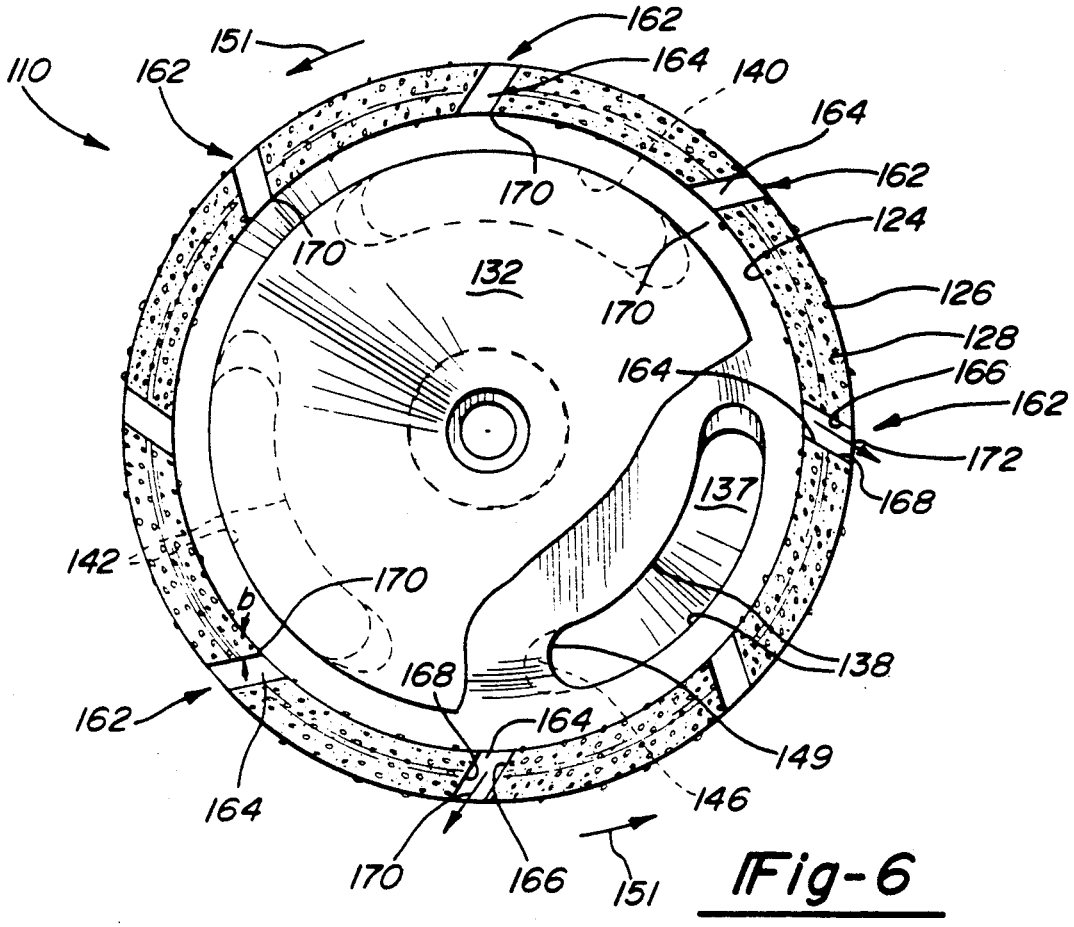
FIG. 6 is a bottom plan view of an alternate embodiment of the present invention including vane pump slots in the radiused end and wall member of the generator wheel of the present invention.
Figure 7:
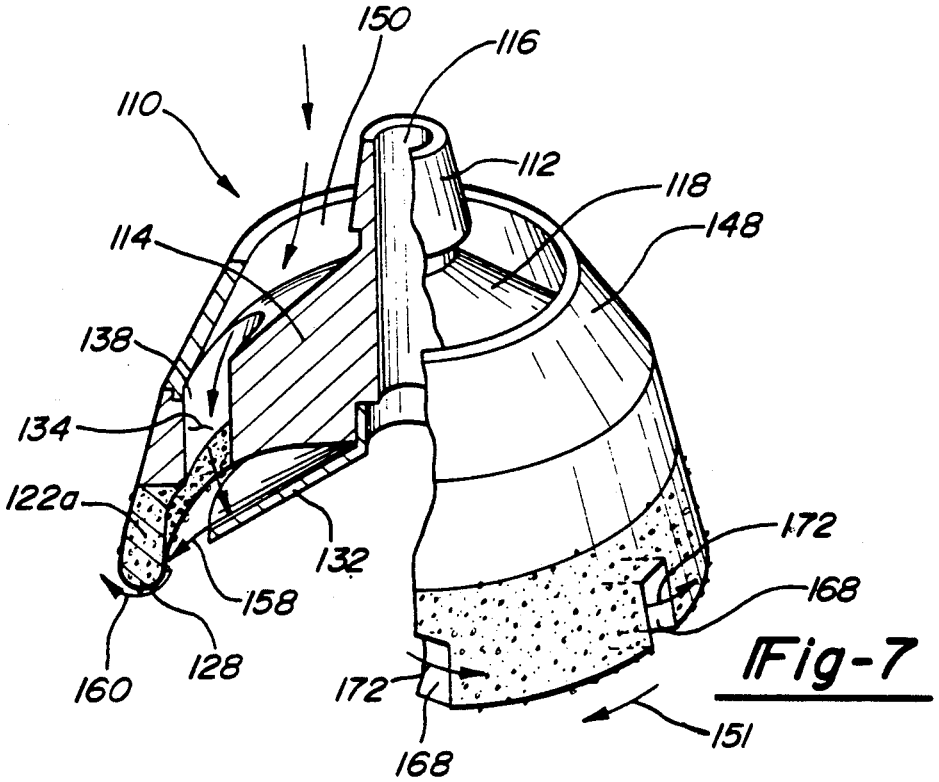
FIG. 7 is a perspective view of the generator wheel of FIG. 6.

Referring now to FIGS. 6 and 7 there is shown an alternate embodiment of a generator wheel 110 made in accordance with the teachings of the present invention.

Generator wheel 110 is substantially like generator wheel 10 and therefore like numbers differing by 100 refer to like elements therein. However, generator wheel 110 includes a wall member 122*a* which is attached to the body portion. Wall member 122*a* is made of a metal bonded impregnated diamond matrix attached to the body 14 rather than as an integral part of the body 14 such as shown in wall 22.

The generator wheel 110 also includes the added advantage of a vane pump means generally indicated at 162 for pumping of coolant to the outside surface 126 of the wall 122*a*. In a preferred embodiment vane pump means 162 includes angled axially directed slots 164 which extend axially from the surface 128 into wall 122*a*. Slots 164 are formed by a pair of parallel surfaces 166 and 168.

As shown best in FIG. 6, the walls 168 have radially inner edges 170 which shear coolant out through slots 164 as shown by arrows 172. This configuration provides improved coolant flow to the radially outer surface 126. In a preferred embodiment the surface 168 is angled to the inner surface at an angle "b" which is preferably from about 5° to about 90° and in a preferred embodiment is about 45°.

In the present invention it is found that because of this coolant pump arrangement a greater amount of coolant can be supplied effectively to the cutting surface of radiused portion 28 such that there is greatly reduced buildup of heat. This reduces heat cracking and the like during generation of photochromic lenses. Also, this improved coolant flow speeds up the lens cutting process by approximately eight times thus creating a decided advantage in increased productivity and reduced material losses. The improved coolant flow provided in the present invention also results in increased life of the cutting surfaces of generator wheel when generating such lenses thereby reducing costs for replacement of such wheels.

While the above description constitutes the preferred embodiment of the present invention, it is to be appreciated that the invention is susceptible to modification, variation and change without departing from the proper scope and the fair meaning of the accompanying claims.

What is claimed is:

1. A ring generator wheel with improved coolant flow for generating of ophthalmic lenses comprising:

a shaft portion adapted for connection to an ophthalmic lens generating machine;

a body portion including a first inlet side adjacent the shaft portion, a second outlet side and a wall member extending from said second outlet side for forming a cupped surface on said second outlet side, said wall member having a radially inner surface, a radially outer surface and a peripheral edge including a means for cutting a lens comprising a radiused cutting edge, a deflection plate means having portions thereof extending generally radially and spaced from said second outlet side for directing a coolant media into said radially inner surface of said outer wall during rotation of said generator wheel;

surfaces for forming an aperture means through said body portion from said first inlet side to said second outlet side for allowing coolant to pass therethrough; and shroud means for containing a coolant on said first inlet side, wherein coolant is directed at said first side during rotation of said generator wheel and is pumped through said aperture means to be distributed via said deflection plate to said radially inner wall for providing increased flow of coolant to said means for cutting whereby the coolant flow flows from said inside radially inner surface and around said radiused cutting edge to said radially outer surface for providing coolant media to the radially inner surface, said radiused cutting edge, and said outer surface for improved cutting.

2. The generator wheel of claim 1 wherein said shroud means further comprises a wall extending from said body portion generally in the axial direction of the shaft.

3. The generator wheel of claim 2 wherein said wall is frustoconical in shape and angled toward said shaft.

4. The ring generator wheel of claim 3 wherein the angle of said frustoconical wall is from about 30° to about 90°.

5. The ring generator wheel of claim 4 wherein the angle is from about 45° to about 70°.

6. The ring generator wheel of claim 1 wherein said deflection plate means is a radially extending plate.

7. The ring generator wheel of claim 6 wherein said plate is circular.

8. The ring generator wheel of claim 6 wherein said plate is frustoconical in shape and extends in a direction outward from said second side.

9. The ring generator wheel of claim 1 wherein said surfaces for forming said aperture means further comprises surfaces forming at least one slot in said body portion.

10. The ring generator wheel of claim 1 wherein said surfaces forming said aperture means further comprises surfaces forming a plurality of slots in said body portion.

11. The ring generator wheel of claim 10 wherein said slots formed are arcuate elongate slots having angled surfaces at either longitudinal end which are angled parallel to one another.

12. The ring generator wheel of claim 11 wherein said slots form a vane pump during rotation of said wheel.

13. The ring generator wheel of claim 1 wherein said means for cutting a lens further comprises a diamond grit brazedly attached to said radiused portion.

14. The ring generator wheel of claim 1 wherein said means for cutting a lens further comprises a polycrystalline flycutter blade.

15. The ring generator wheel of claim 1 wherein said peripheral edge further comprises a toric shaped section.

16. The ring generator wheel of claim 1 wherein said wall member is formed from a metal bonded impregnated diamond matrix material.

17. The ring generator wheel of claim 1 wherein said wall member is formed from a metal bonded impregnated diamond matrix material.

18. A ring generator wheel with improved coolant flow for generating of ophthalmic lenses comprising:

a shaft portion adapted for connection to an ophthalmic lens generating machine;

a body portion including a first inlet side adjacent the shaft portion, a second outlet side and a wall member extending from said second side for forming a cupped surface on said second side, said wall member having a radially inner surface, a radially outer surface and a peripheral edge including a means for cutting a lens comprising a toric shaped abrasive section; and a deflection plate means having portions thereof extending generally radially and spaced from said second outlet side for directing a coolant media into said radially inner surface of said outer wall during rotation of said generator wheel, integral valve pump means operative during rotation of said generator wheel for pumping coolant from said first inlet side to said second outlet side and into said deflection plate means, said toric shaped section facilitating coolant flow from the radially inner surface over said toric shaped section to said radially outer surface.

19. The ring generator wheel of claim 18 wherein said vane pump means further comprises:

surfaces for forming an aperture means through said body portion from said first side to said second side for allowing coolant to pass therethrough; and shroud means for containing a coolant on said first inlet side, wherein coolant is directed at said shroud means and is pumped through said aperture means to be distributed via said deflection plate to said radially inner wall for providing increased flow of coolant to said means for cutting.

20. The generator wheel of claim 19 wherein said shroud means further comprises a wall extending from said body portion generally in the axial direction of the shaft.

21. The generator wheel of claim 20 wherein said wall is frustoconical in shape and angled toward said shaft.

22. The ring generator wheel of claim 21 wherein the angle of said frustoconical wall is from about 30° to about 90°.

23. The ring generator wheel of claim 22 wherein the angle is from about 45° to about 70°.

24. The ring generator wheel of claim 18 wherein said deflection plate means is a radially extending plate.

25. The ring generator wheel of claim 24 wherein said plate is circular.

26. The ring generator wheel of claim 24 wherein said plate is frustoconical in shape and extends in a direction outward from said second side.

27. The ring generator wheel of claim 18 wherein said surfaces for forming said aperture means further comprises surfaces forming at least one slot in said body portion.

28. The ring generator wheel of claim 18 wherein said surfaces forming said aperture means further comprises surfaces forming a plurality of slots in said body portion.

29. The ring generator wheel of claim 28 wherein said slots formed are arcuate elongate slots having angled surfaces at either longitudinal end which are angled in a plate parallel to one another.

30. The ring generator wheel of claim 29 wherein said slots form a vane pump during rotation of said wheel.

31. The ring generator wheel of claim 18 wherein said means for cutting a lens further comprises a diamond grit brazedly attached to said radiused portion.

32. The ring generator wheel of claim 18 wherein said means for cutting a lens further comprises a polycrystalline flycutter blade.

33. The ring generator wheel of claim 18 wherein said wall member is formed from a metal bonded impregnated diamond matrix material.

34. The ring generator wheel of claim 18 wherein said wall member is formed from a metal bonded impregnated diamond matrix material.

35. A ring generator wheel with improved coolant flow for generating of ophthalmic lenses comprising:

a shaft portion adapted for connection to an ophthalmic lens generating machine;

a body portion including a first inlet side adjacent the shaft portion, a second outlet side and a wall member extending from said second outlet side for forming a cupped surface on said second outlet side, said wall member having a radially inner surface, a radially outer surface and a peripheral edge including a means for cutting a lens comprising a toric shaped abrasive section;

deflection plate means having portions thereof extending generally radially and spaced from said second side for directing a coolant media into said radially inner surface of said outer wall during rotation of said ring generator wheel;

first integral vane pump means operative during rotation of said generator wheel for pumping a coolant from said first inlet side to said second outlet side and into said deflection plate means; and second vane pump means operable during rotation of said wheel for pumping of coolant through said wall member from said radially inner surface over said toric shaped abrasive section to said radially outer surface.

36. The ring generator wheel of claim 35 wherein said first vane pump means further comprises:

surfaces for forming an aperture means through said body portion from said first side to said second side for allowing coolant to pass therethrough; and shroud means for containing a coolant on said second side, wherein coolant is directed at said shroud means and is pumped through said aperture means to be distributed via said deflection plate to said radially inner wall for providing increased flow of coolant to said means for cutting.

37. The ring generator wheel of claim 35 wherein said second vane pump means further comprises a plurality of slots in said wall member extending from said radially inner side to said radially outer side.

38. The ring generator wheel of claim 37 wherein said slots extend axially into said wall from said peripheral edge.

39. The ring generator wheel of claim 38 wherein said slots are angled with respect to the inner wall such that one wall of the sot forms an edge for shearing of the coolant thereby forcing the coolant through the slot.

40. The generator wheel of claim 36 wherein said shroud means further comprises a wall extending from said body portion generally in the axial direction of the shaft.

41. The generator wheel of claim 40 wherein said wall is frustoconical in shape and angled toward said shaft.

42. The ring generator wheel of claim 41 wherein the angle of said frustoconical wall is from about 30° to about 90°.

43. The ring generator wheel of claim 42 wherein the angle is from about 45° to about 70°.

44. The ring generator wheel of claim 35 wherein said deflection plate means is a radially extending plate.

45. The ring generator wheel of claim 44 wherein plate is circular.

46. The ring generator wheel of claim 44 wherein said plate is frustoconical in shape and extends in a direction outward from said second side.

47. The ring generator wheel of claim 36 wherein said surfaces for forming said aperture means further comprises surfaces forming at least one slot in said body portion.

48. The ring generator wheel of claim 36 wherein said surfaces forming said aperture means further comprises surfaces forming a plurality of slots in said body portion.

49. The ring generator wheel of claim 48 wherein said slots formed are arcuate elongate slots having angled surfaces at either longitudinal end which are angled parallel to one another.

50. The ring generator wheel of claim 49 wherein said slots form a vane pump during rotation of said wheel.

51. The ring generator wheel of claim 35 wherein said means for cutting a lens further comprises a diamond grit brazedly attached to said radiused portion.

52. The ring generator wheel of claim 35 wherein said means for cutting a lens further comprises a polycrystalline flycutter blade.

53. The ring generator wheel of claim 38 wherein said wall member is formed from a metal bonded impregnated diameter matrix material.

54. The ring generator wheel of claim 39 wherein said wall member is formed from a metal bonded impregnated diamond matrix material.

55. A ring generator wheel with improved coolant flow for generating of ophthalmic lenses comprising:

a shaft portion adapted for connection to an ophthalmic lens generating machine;

a body portion including a first inlet side adjacent the shaft portion, a second outlet side and a wall member extending from said second side for forming a cupped surface on said second outlet side, said wall member being formed of a metal bonded impregnate diamond matrix material having a radially inner surface, a radially outer surface and a radiused peripheral edge including a means for cutting a lens;

a deflection plate means having portions thereof extending generally radially and spaced from said second side for directing a coolant media into said radially inner surface of said outer wall;

surfaces for forming an aperture means through said body portion from said first inlet side to said second outlet side for allowing coolant to pass therethrough;

shroud means for containing a coolant on said first inlet side, wherein coolant is directed at said shroud means and is pumped through said aperture means to be distributed via said deflection plate to said radially inner wall for providing increased flow of coolant to said means for cutting; and vane pump means for pumping of coolant through said wall member from said radially inner side over said radiused peripheral edge to said radially outer side to facilitate flow of coolant over the cutting surfaces of said radiused peripheral edge.

56. The ring generator wheel of claim 55 wherein said second vane pump means further comprises a plurality of slots in said wall member extending from said radially inner side to said radially outer side.

57. The ring generator wheel of claim 55 wherein said slots extend axially into said wall from said peripheral edge.

58. The ring generator wheel of claim 55 wherein said slots are angled with respect to the inner wall such that one wall of the sot forms an edge for shearing of the coolant thereby forcing the coolant through the slot.

59. The generator wheel of claim 55 wherein said shroud means further comprises a wall extending from said body portion generally in the axial direction of the shaft.

60. The generator wheel of claim 59 wherein said wall is frustoconical in shape and angled toward said shaft.

61. The ring generator wheel of claim 60 wherein the angle of said frustoconical wall is from about 30° to about 90°.

62. The ring generator wheel of claim 61 wherein said deflection plate means is a radially extending plate.

63. The ring generator wheel of claim 62 wherein said plate is circular.

64. The ring generator wheel of claim 62 wherein said plate is frustoconical in shape and extends in a direction outward from said second side.

65. The ring generator wheel of claim 55 wherein said surfaces for forming said aperture means further comprises surfaces forming at least one slot in said body portion.

66. The ring generator wheel of claim 55 wherein said surfaces forming said aperture means further comprises surfaces forming a plurality of slots in said body portion.

67. The ring generator wheel of claim 66 wherein said slots formed are arcuate elongate slots having angled surfaces at either longitudinal end which are angled parallel to one another.

68. The ring generator wheel of claim 67 wherein said slots form a vane pump during rotation of said wheel.

* * * * *

UNITED STATES PATENT AND TRADEMARK OFFICE

CERTIFICATE OF CORRECTION

PATENT NO. : 5,259,148

DATED : November 9, 1993

INVENTOR(S) : Ronald C. Wiand

It is certified that error appears in the above-indentified patent and that said Letters Patent is hereby corrected as shown below:

Col. 7, line 55, claim 45
before "plate" insert --said--

Col. 8, line 13, claim 53
"diameter" should be --diamond--

Col. 8, line 60, claim 58
"sot" should be --slot--

Signed and Sealed this

Twenty-fourth Day of May, 1994

Bruce Lehman

*Attest:*

BRUCE LEHMAN

*Attesting Officer*

*Commissioner of Patents and Trademarks*